US007470336B2

(12) United States Patent
Buck

(10) Patent No.: US 7,470,336 B2
(45) **Date of Patent: *Dec. 30, 2008**

(54) METHOD OF PRODUCING FINE-GRAINED MARTENSITIC STAINLESS STEEL

(75) Inventor: Robert F. Buck, Trafford, PA (US)

(73) Assignee: Advanced Steel Technology LLC, Trafford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/868,078

(22) Filed: Oct. 5, 2007

(65) Prior Publication Data

US 2008/0073005 A1 Mar. 27, 2008

Related U.S. Application Data

(60) Division of application No. 10/544,887, filed as application No. PCT/US2004/003876 on Feb. 6, 2004, which is a continuation of application No. 10/706,154, filed on Nov. 12, 2003, now Pat. No. 6,890,393, and a continuation of application No. 10/431,680, filed on May 8, 2003, now Pat. No. 6,899,773.

(60) Provisional application No. 60/445,740, filed on Feb. 7, 2003.

(51) Int. Cl.
*C21D 8/02* (2006.01)
*C21D 8/10* (2006.01)

(52) U.S. Cl. ..... 148/654; 148/653; 148/592; 148/593; 148/608; 148/609; 148/546; 148/547; 148/707

(58) Field of Classification Search ..... 148/148, 148/325, 326, 333, 334, 328, 592, 593, 608, 148/609, 653, 654, 546, 547, 707; 420/68, 420/70, 109, 110, 112, 584.1, 586, 586.1
See application file for complete search history.

(56) References Cited

U.S. PATENT DOCUMENTS

| | | | | |
|---|---|---|---|---|
| 2,999,039 | A * | 9/1961 | Lula et al. | 420/62 |
| 3,660,176 | A * | 5/1972 | Denhard, Jr. | 148/565 |
| 6,890,393 | B2 * | 5/2005 | Buck | 148/325 |
| 6,899,773 | B2 * | 5/2005 | Buck | 148/325 |

FOREIGN PATENT DOCUMENTS

| | | | |
|---|---|---|---|
| JP | 06-33195 | * | 2/1994 |
| JP | 2000-226641 | * | 8/2000 |

* cited by examiner

*Primary Examiner*—Deborah Yee
(74) *Attorney, Agent, or Firm*—Osha·Liang LLP

(57) ABSTRACT

A martensitic alloy in which the ASTM grain size number is at least 5, including (wt. %) up to about 0.5% C, at least about 5% Cr, at least about 0.5% Ni, up to about 15% Co, up to about 8% Cu, up to about 8% Mn, up to about 4% Si, up to about 6% (Mo+W), up to about 1.5% Ti, up to about 3% V, up to about 0.5% Al, and at least about 40% Fe.

25 Claims, 2 Drawing Sheets

METHOD OF PRODUCING FINE-GRAINED MARTENSITIC STAINLESS STEEL

This is a divisional of U.S. patent application Ser. No. 10/544,887 filed on Aug. 5, 2005, which is a 371 of PCT Application No. PCT/2004/003876 filed on Feb. 6, 2004, which claims priority to U.S. Provisional Application Ser. No. 60/445,740 filed on Feb. 7, 2003, U.S. application Ser. No. 10/431,680, filed on May 8, 2003, now U.S. Pat. No. 6,899,773 issued May 31, 2005 and U.S. application Ser. No. 10/706,154, filed Nov. 12, 2003, now U.S. Pat. No. 6,890,393 issued May 10, 2005 the entire contents of which are incorporated herein by reference in their entirety.

FIELD

This disclosure relates to an iron based, fine-grained, martensitic stainless steel.

BRIEF DESCRIPTION OF THE TABLES AND DRAWINGS

Table I lists the chemistry of steel samples.

Table II gives the mechanical properties of steel samples.

BACKGROUND

Figure 1:
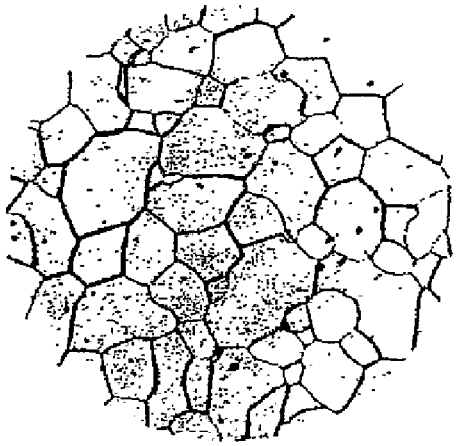
FIG. 1 is a reference microstructure magnified at 100×.

Conventional martensitic stainless steels usually contain 10.5% to 13% chromium and up to 0.25% carbon. Precipitation hardening martensitic stainless grades contain up to 17% chromium. Chromium, when dissolved in solid solution, provides the corrosion resistance characteristic of stainless steels. Many martensitic stainless steels also contain (i) ferrite stabilizing elements such as molybdenum, tungsten, vanadium, and/or niobium to increase strength; (ii) austenite stabilizing elements such as nickel and manganese to minimize delta ferrite formation and getter sulfur, respectively; and (iii) deoxidizing elements, such as aluminum and silicon, Copper is sometimes present in precipitation hardening martensitic stainless grades.

Conventional martensitic stainless steels are usually hot worked to their final shape, then heat treated to impart an attractive combination of mechanical properties, e.g., high strength and good toughness, within limited attainable ranges. Typical heat treatment of conventional martensitic stainless steels involves soaking the steel between approximately 950° C. and 1100° C. and air cooling ("normalizing"), oil quenching, or water quenching to room temperature, and subsequently tempering the steel usually between 560° C. and 750° C. Tempering of conventional martensitic stainless steels results in the precipitation of nearly all carbon as chromium-rich carbides (i.e., $M_{23}C_6$) and other alloy carbides (e.g., $M_6C$) which generally precipitate on martensite lath boundaries and prior austenite grain boundaries in the body-centered-cubic or body-centered-tetragonal ferrite matrix. ("M" represents a combination of various metal atoms, such as chromium, molybdenum and iron.)

In 12-13% Cr steels, approximately 18 of the 23 metal atoms in $M_{23}C_6$ particles are chromium atoms. Thus, for every 6 carbon atoms that precipitate in $M_{23}C_6$ particles, approximately 18 chromium atoms also precipitate (a carbon to chromium atomic ratio of 1:3). The volume fraction of $M_{23}C_6$ precipitates is usually proportional to the carbon content. Therefore, in a 12% Cr steel with 0.21 wt % carbon (which equals approximately 1 atom % carbon), about 3 wt % chromium (~3 atom % chromium) precipitates as $M_{23}C_6$ particles, leaving an average of about 9 wt. % chromium dissolved in solid solution in the matrix. If this material were tempered at a relatively high temperature, the chromium remaining in solid solution (~9%) would be uniformly distributed in the matrix due to thermal atomic diffusion. However, if the tempering temperature is relatively low and diffusion is sluggish, regions surrounding the $M_{23}C_6$ precipitates will contain less chromium than regions further away from the particles. This heterogeneous distribution of chromium in solid solution is known as sensitization and can cause accelerated localized corrosion in chromium-lean areas immediately surrounding the $M_{23}C_6$ particles. To preclude sensitization of conventional 12% Cr steels with relatively high carbon contents, high tempering temperatures are used. However, the yield strength (0.2% offset) of conventional martensitic stainless steels is reduced after tempering at high temperatures—generally to less than 760 MPa.

Several martensitic stainless steels have been developed that contain low levels of carbon (<0.02 wt. %) and relatively high amounts of nickel and other solid solution strengthening elements, such as molybdenum. Although these low carbon martensitic stainless steels are not generally susceptible to sensitization, they can be heat treated to yield strengths only up to about 900 MPa. Moreover, the cost of these steels is relatively high, primarily because of the large amounts of expensive nickel and molybdenum in them.

U.S. Pat. No. 5,310,431, issued to the present inventor, discloses "an iron-based, corrosion-resistant, precipitation strengthened, martensitic steel essentially free of delta ferrite for use at high temperatures has a nominal composition of 0.05-0.1 C, 8-12 Cr, 1-5 Co, 0.52-2.0 Ni, 0.41-1.0 Mo, 0.1-0.5 Ti, and the balance iron. This steel is different from other corrosion-resistant martensitic steels because its microstructure consists of a uniform dispersion of fine particles, which are very closely spaced, and which do not coarsen at high temperatures. Thus at high temperatures this steel combines the excellent creep strength of dispersion-strengthened steels, with the ease of fabricability afforded by precipitation hardenable steels." U.S. Pat. No. 5,310,431 is herein incorporated by reference in its entirety.

DETAILED DESCRIPTION

This disclosure relates to an iron based, fine-grained, martensitic stainless steel made using thermal mechanical treatment and strengthened with a relatively uniform dispersion of coarsening-resistant, MX type precipitates. In one embodiment, a nominal composition is (wt. %): 0.05<C<0.15; 7.5<Cr<15; 1<Ni<7; Co<10, Cu<5; Mn<5; Si<1.5; (Mo+W)<4; 0.01<Ti<0.75; 0.135<(1.17 Ti+0.6 Nb+0.6 Zr+0.31 Ta+0.31 Hf)<1; V<2; N<0.1; Al<0.2; (Al+Si+Ti)>0.01; where the balance may be made up of iron and impurities.

In one embodiment, an iron based alloy is provided, having greater than 7.5% chromium and less than 15% Cr, in another embodiment, having 10.5-13% Cr, which when acted upon with a thermal mechanical treatment according to the present disclosure has fine grains and a superior combination of tensile properties and impact toughness. The mechanical properties of the steel of the present disclosure are believed to be largely attributable to the fine grain size and also the coarsening resistance of the small, secondary MX particles. These microstructural features are a result of the combination of the chemical composition of the alloy and the thermal mechanical treatment. Appropriate alloy compositions and thermal mechanical treatments are chosen such that the majority of the interstitial solute (mostly carbon) is in the form of secondary MX particles.

It will be understood in metallurgical terms that for the term "MX particle," M represents metal atoms, X represents interstitial atoms, i.e., carbon and/or nitrogen, and that the MX particle could be a carbide, nitride or carbonitride particle. Generally, there are two types of MX particles: primary (large or coarse) MX particles, and secondary (small or fine) MX particles. Primary MX particles in steel are usually greater than about 0.5 □m (500 nm) in size and secondary (small or fine) MX particles are usually less than about 0.2 □m (200 nm) in size. The conditions under which different metal atoms form MX particles vary with the compositions of steel alloys.

In the present disclosure, small secondary MX particles may be formed (where M=Ti, Nb, V, Ta, Hf, and/or Zr, and X=C and/or N). In one embodiment, MX particles are formed using Ti. One benefit of adding a relatively large amount of titanium to the steel (versus other strong carbide forming elements) is that sulfur can be gettered in the form of titanium carbo-sulfide ($Ti_4C_2S_2$) particles rather than manganese sulfide (MnS) or other types of sulfide particles. Because titanium carbo-sulfides are known to be more resistant to dissolution in certain aqueous environments than other sulfides, and because dissolution of some sulfide particles located on the surface results in pitting, the pitting resistance of the steel of this embodiment may be increased if sulfur inclusions are present as titanium carbo-sulfides.

In one embodiment titanium is used as an alloying element, because of its relatively low cost compared to other alloying elements such as niobium, vanadium, tantalum, zirconium and halfnium.

In one embodiment titanium is used as an alloying element because titanium carbide particles have greater thermodynamic stability than some other types of carbide particles, and therefore may be more effective at pinning grains at high hot working temperatures which ultimately leads to better mechanical properties.

In another embodiment recrystallization and precipitation of fine MX particles are caused to occur essentially simultaneously, or at nearly the same time, during the process of thermal mechanical treatment. According to this embodiment the thermal mechanical treatment includes soaking the steel at an appropriate austenitizing temperature to dissolve most of the MX particles, and hot working the steel while at a temperature at which secondary MX precipitation and recrystallization will both occur because of the imposed strain, hot working temperature and balanced chemistry. In this embodiment, the thermal mechanical treatment is accomplished at temperatures above about 1000° C., provided a true stain of at least about 0.15 (15%) is applied mechanically.

At certain temperatures it has been observed that as the strain increases, recrystallization kinetics also increase (assuming the strain is applied at a temperature that is high enough to preclude pancaking). If insufficient strain is imposed and/or the hot deformation is not applied at a high enough temperature, MX precipitation may still occur, but full recrystallization may not. It has been found that by producing a sufficiently large volume fraction and number density of fine MX precipitates at the same time, or about the same time, that recrystallization is initiated, grain growth during and after subsequent hot working may also be limited. The grains are recrystallized into small, equiaxed grains and the fine, secondary MX precipitates inhibit subsequent grain growth so that small, equiaxed grains may be retained to a great extent in the final product. In one embodiment, fine grain size in which the ASTM grain size number is 5 or greater provides good mechanical properties to the resulting steel, and can be obtained according to the present disclosure.

The chemical composition of the alloy may be designed to produce a large volume fraction and a large number density of the fine MX particles as precipitates in the alloy when it is thermal mechanically treated. The precipitates that form during and after hot working are secondary precipitates, rather than the large undissolved primary particles that may be present during austenization. Small secondary precipitates may be more effective at pinning grains and hindering grain growth than are larger primary particles.

In one embodiment, second phase particles may be used to strengthen the steel, where the particles are the MX-type (NaCl crystal structure), instead of chromium-rich carbides such as $M_{23}C_6$ and $M_6C$.

In another embodiment, the secondary MX particles generally precipitate on dislocations and result in a relatively uniform precipitate dispersion. In this embodiment, precipitate dispersions are relatively uniform.

In another embodiment, small MX particles limit growth of newly-formed (recrystallized) grains during the thermal mechanical treatment. In the steel of the current disclosure, the presence of a relatively large volume fraction and number density of fine MX particles in the microstructure (due to hot working) hinders growth of recrystallized grains even at high hot working temperatures, and hence contributes to a fine-grained structure being retained to room temperature. This embodiment utilizes controlled thermal mechanical treatment in conjunction with a specially-designed martensitic stainless steel composition to limit grain growth and improve toughness.

In another embodiment the steel of the current disclosure (after proper thermal mechanical treatment) can be subsequently austenitized at relatively high soaking temperatures without resulting in excessive grain growth. In this embodiment the MX particles do not coarsen or dissolve appreciably at intermediate temperatures (up to about 1150° C.).

Creep strength in steels generally decreases with decreasing grain size. Therefore, in one embodiment the creep strength of the steel of the current disclosure, due to its fine grain size, is not expected to be as high as it might otherwise be if the grain size were large. In this embodiment, the steel of the current disclosure is not expected to be especially creep-resistant at temperatures within the generally-accepted creep regime, i.e., temperatures greater than one-half of the absolute melting temperature (T/Tm>0.5) of the steel.

In another embodiment, the steel of the current disclosure may be used in such industrial applications as tubing, bars, plates, wire, other products for the oil and gas industry, as well as and other products that require a combination of excellent mechanical properties and good corrosion resistance.

Surprisingly, it has been found that by properly applying a thermal mechanical treatment (TMT) to a martensitic stainless steel having a carefully balanced composition, a fine-grained microstructure is created that exhibits good tensile properties at room temperature, high impact toughness at low temperature, and good corrosion resistance at elevated temperatures.

In one embodiment, the chemistry of the martensitic stainless steel may be balanced so as to do one or more of the following: (i) provide adequate corrosion resistance, (ii) prevent or minimize the formation of delta ferrite at high austenitizing temperatures, (iii) preclude or minimize the presence of retained austenite at room temperature, (iv) contain sufficient amounts of carbon and strong carbide forming elements to precipitate as MX-type particles, (v) be sufficiently deoxidized, and/or (vi) be relatively clean (minimize impurities). The thermal mechanical treatment according to the disclosure may be applied relatively uniformly throughout the work piece, at sufficiently high temperatures, and at sufficiently high true strains so that one or more of the following occurs: (i) most of the microstructure recrystalizes, resulting in small equiaxed grains, and/or (ii) the dislocation density increases, thereby providing MX particle nucleation sites.

In one embodiment, a suitable design of a steel chemistry and a thermal mechanical treatment will be explained in greater detail below:

Selection of elements from the following six groups facilitates the desired results:

1. Strong Carbide/Nitride Forming Elements (Ti, Nb, V, Hf, Zr, and Ta)

In this embodiment, it is desired to precipitate the interstitial solute (carbon and nitrogen) as thermodynamically-stable particles, and to maximize their volume fraction Not all strong carbide/nitride forming elements are equal in terms of their cost availability, effect on non-metallic Inclusion formation, or the thermodynamic stability of their respective carbides, nitrides and/or carbo-nitrides. Given these considerations it has been found that titanium carbide is the preferred particle to use in the steel of this embodiment. Because titanium also forms undesirable primary titanium nitride particles, however, efforts are made to provide a chemical composition for the alloy that limits nitride formation.

Like titanium, Nb, Ta, Zr, and Hf also form carbides and nitrides with high thermodynamic stability and therefore, if used in appropriate quantities, could be used alone or in combination with Ti, without departing from certain aspects of this embodiment Vanadium nitrides also have relatively high thermodynamic stability, but vanadium carbides do not. As such, vanadium nitride particles could also be used without departing from certain aspects of this embodiment. However, V, Ta, Zr, Hf, and Nb are generally not as desirable as Ti because they are more expensive than Ti. Furthermore, niobium, tantalum, zirconium, vanadium, and halfnium may not getter sulfur as a desirable inclusion, as titanium does in the form of $Ti_4C_2S_2$. In another embodiment, combinations of one or more of the aforementioned various strong carbide forming elements could be used to form the secondary MX particles.

Part of the thermal mechanical treatment involves soaking the alloy at an elevated temperature prior to mechanically straining the alloy by hot working. There are two objectives during soaking prior to such hot working: (i) most of the strong carbide/nitride forming elements should be dissolved in solid solution, and (ii) the temperature should be high enough throughout the material so as to facilitate the recrystallization of the microstructure during hot working. In one embodiment, the soaking temperature should be approximately the MX dissolution temperature, which depends on the amounts of M (strong carbide forming metal atoms), and X (C and/or N atoms) in the bulk alloy, or for example within about 20° C. of the MX dissolution temperature. The amount of undissolved primary MX particles should be minimized to achieve the best mechanical properties. Such minimization has been considered in connection with designing the chemical composition of the alloy. The steel should be kept at the soaking temperature for a time period sufficient to result in a homogeneous distribution of the strong carbide forming element(s), for example about 1 hour. The desired atomic stoichiometry between strong carbide forming elements and interstitial solute elements (carbon and nitrogen) should be approximately 1:1 to promote formation of MX precipitates. In this embodiment, the chemical composition is designed to minimize nitride formation (by limiting nitrogen) without undue cost, for example less than about 0.1 wt. % in the solution.

In one embodiment to achieve the desired strength level and volume fraction of secondary MX particles, the total amount of Ti and other strong carbide forming elements (zirconium, niobium, tantalum, and hafnium) should range from about 0.135 atom % to less than about 1.0 atom %. This amount of strong carbide forming elements Ti, Nb, Zr, Ta, and Hf is sufficient to effectively pin the newly-formed grains after recrystallization. The metallurgical term "pin" is used to describe the phenomenon whereby particles at a grain boundary sufficiently reduce the energy of the particle/matrix/boundary system to resist migration of the grain boundary and thereby hinder grain growth. A sufficiently high MX volume fraction will reduce grain growth kinetics during and after recrystallation. This amount of strong carbide forming elements Ti, Nb, Zr, Ta, and Hf leads to optimized mechanical properties. In another embodiment, from about 0.01 wt. % to less than about 0.75 wt. % titanium is present for example to promote gettering sulfur as $Ti_4C_2S_2$, but minimizing the formation of primary MX particles.

In another embodiment, the atom percentages of titanium, niobium, zirconium, tantalum, and halfnium may be governed by multiplying the weight percentages of each element by the following multiples: about 1.17 (Ti), about 0.6 (Nb), about 0.6 (Zr), about 0.31 (Ta), and about 0.31 (Hf, respectively.

In another embodiment, if vanadium and niobium (also known as columbium) are present, V should be limited to less than about 2 wt. %, for example less than about 0.9 wt. %, and Nb should be limited to less than about 1-7%, for example less than about 1 wt. % to prevent delta ferrite formation.

2. Interstitial Solute Elements (C and N).

In another embodiment the amount of carbon and nitrogen depends upon the amount of strong carbide (and nitride) forming elements present and should approximate an M:X atomic stoichiometry of 1:1. Because of the presence of titanium, zirconium, niobium, hafnium and/or tantalum; the nitrogen content should be kept relatively low to minimize the formation of primary nitride particles (inclusions), which do not dissolve appreciably even at very high soaking temperatures. One suitable method to limit nitrogen content is to melt the steel using vacuum induction. Utilizing vacuum induction melting, the nitrogen content can be limited to less than about 0.02 wt. %. In another embodiment, the steel may be melted in air utilizing an electric arc furnace. Because nitrogen solubility in molten steel increases with increasing chromium content, air melting may result in a nitrogen content of about 0.05 wt. % or higher. In another embodiment, nitrogen levels are less than about 0.1 wt. %, for example less than about 0.065 wt. %. In another embodiment, at least about 0.05 wt. % carbon and less than about 0.15 wt. % should be present for example to achieve a desired volume fraction of secondary MX particles (predominantly MC particles). Optionally, in this embodiment nitrogen content is limited to less than about 0.1 wt. %.

3. Non-Carbide Forming, Austenite Stabilizing Elements (Ni, Mn, Co, and Cu) and Ferrite Stabilizing Elements (Si, Mo, and W)

In one embodiment sufficient amounts of austenite stabilizing elements are present to maintain the structure fully austenitic during soaking (austenitizing), thereby minimizing or precluding the simultaneous presence of delta ferrite.

In one embodiment; nickel is the primary non-precipitating austenite stabilizing element added to minimize delta ferrite formation, whereas manganese may optionally be present as a secondary, non-precipitating, austenite stabilizing element (In conventional steels, Mn may also getter sulfur.) Both nickel and manganese may serve to reduce the Ac1 temperature. Optionally, ferrite stabilizing elements such as molybdenum, tungsten, and silicon may also be present in the steel, which serve to raise the Ac1 temperature and/or increase the strength by solid solution strengthening. In one embodiment, molybdenum increases the pitting resistance of the steel in certain environments, while in another embodiment silicon enhances corrosion resistance and is a potent deoxidizer.

The Ac1 temperature (also known as the lower critical temperature) is the temperature at which steel with a martensitic, bainitic, or ferritic structure (body-centered-cubic or body-centered-tetragonal) begins to transform to austenite (face-centered-cubic) upon heating from room temperature. Generally, the Ac1 temperature defines the highest temperature at which a martensitic steel can be effectively tempered (without reforming austenite, which could then transform to martensite upon cooling to room temperature). Austenite stabilizing elements usually lower the Ac1 temperature, while ferrite stabilizing elements generally raise it. Because there are certain circumstances in which it would be desired to temper the steel at a relatively high temperature (during post weld heat treating, for example, where weldment hardness should be limited), in one embodiment the Ac1 temperature is maintained relatively high.

In another embodiment, a microstructure is created that has a minimal amount of, or is free of delta ferrite. To minimize the presence of delta ferrite, the following relation should be met:

$$NI>CR-7$$

where NI=nickel equivalent=Ni+0.11Mn−0.0086 $Mn^2$+0.41 Co+0.44Cu+184N+24.5C (in which N and C are the amounts in solution at the austenitizing temperature), and CR=chromium equivalent=Cr+1.21 Mo+2.27V+0.72W+2-2Ti+0.14Nb+0.21Ta+2.48Al, where the amounts of all elements are expressed in terms of weight percent.

The Ac1 temperature and the presence of delta ferrite are primarily determined by the balance of ferrite stabilizing elements and austenite stabilizing elements in the steel, and can be estimated as follows:

$$Ac1(^\circ C.)=760-5Co-30N-25Mn+10W+25Si+26Mo+50V$$

where the amounts of all elements are expressed in terms of weight percent.

In another embodiment the proper overall balance between austenite stabilizing elements and ferrite stabilizing elements is met, and limits on individual elements are also established as set forth below, to keep the Ac1 temperature relatively high while the formation of delta ferrite is minimized or avoided.

In one embodiment, at least greater than about 1 wt. % to about 7 wt % nickel, for example at least greater than about 1.5 wt % to about 5 wt % nickel are present to prevent formation of delta ferrite, and to limit the Ac1 temperature from decreasing too much. In another embodiment, at least greater than about 1 wt % to about 5 wt % manganese are present to limit the Ac1 temperature from decreasing too much. It will be understood that at the lower nickel levels, greater amounts of manganese or other austenite stabilizing element(s) would be needed to maintain a fully austenitic structure at high austenitizing temperatures. Moreover, if relatively large amounts of ferrite-stabilizing elements (e.g., molybdenum) are present nickel in the upper range specified (i.e., 5-7%) would be needed to maintain the structure fully austenitic (and minimize delta ferrite formation) at high soaking temperatures.

In one embodiment, the element cobalt is less than about 10 wt. %, for example less than about 4 wt. %, to minimize cost and to maintain the Ac1 temperature as high as possible. In another embodiment copper is limited to less than about 5 wt. %, for example less than about 1.2 wt. %, to minimize cost, and to maintain the Ac1 temperature as high as possible.

In another embodiment, the addition of too much ferrite stabilizing elements would promote delta ferrite formation and hence, degrade mechanical properties, and therefore, the sum of molybdenum plus tungsten is limited to less than about 4 wt. %, while silicon is limited to less than about 1.5 wt. %, for example less than about 1 wt. %.

4. Corrosion Resistance (Cr)

For good resistance to atmospheric corrosion and corrosion from carbon dioxide ($CO_2$) dissolved in aqueous solutions (carbonic acid), the steel should contain the appropriate amount of chromium. General corrosion resistance is typically proportional to the chromium level in the steel. A minimum chromium content of greater than about 7.5 wt. % is desirable for adequate corrosion resistance. However, to maintain a structure that is free of delta ferrite at soaking temperatures, chromium should be limited to 15 wt. %.

5. Impurity Getterers (Al, Si, Ce, Ca, Y, Mg, La, Be, B, Sc)

Appropriate amounts of elements to getter oxygen should be added including aluminum and silicon. Although titanium may also be used to getter oxygen, its use would be relatively expensive if it were used in lieu of aluminum and/or silicon. Nonetheless, the use of titanium as an alloying element in the alloy of the present disclosure makes Al a desirable oxygen getterer. Rare earth elements cerium and lanthanum may also be added, but are not necessary. Therefore, the sum of aluminum, silicon and titanium should be at least 0.01 wt. %. The total amount of Al should be limited to less than 0.2 wt %, while cerium, calcium, yttrium, magnesium, lanthanum, boron, scandium and beryllium should each be limited to less than 0.1 wt % otherwise mechanical properties would be degraded.

6. Impurities (S, P, Sn, Sb, Pb, O)

In one embodiment to maintain adequate toughness and a good combination of mechanical properties, sulfur is limited to less than about 0.05 wt. %, for example less than about 0.03 wt. %. In another embodiment phosphorus is limited to less than about 0.1 wt. %. In another embodiment, all other impurities Including tin, antimony, lead and oxygen should each be limited to less than about 0.1 wt. %, for example less than about 0.05 wt %.

Thermal Mechanical Treatment

The purpose of a thermal mechanical treatment is to recrystallize the microstructure during hot working and precipitate a uniform dispersion of fine MX particles, in order to pin the boundaries of the newly-recrystallized grains such that a fine-grained, equiaxed microstructure is obtained after cooling to room temperature. In one embodiment, in order to successfully implement the thermal mechanical treatment, the recrystallization kinetics should be rapid enough such that complete or near complete recrystallization occurs during the hot working process. Generally recrystallization kinetics are more rapid at higher temperatures than at lower temperatures. If recrystallization is relatively sluggish for a given amount of hot work imparted to the steel, the subsequent grain morphology may be "pancaked" (large grain aspect ratio) and mechanical properties may be degraded. In one embodiment, the thermal mechanical treatment is not for the purpose of increasing creep strength. Upon obtaining equiaxed fine grains after recrystallization, the small grains should be prevented or hindered from growing appreciably upon cooling to room temperature.

In one embodiment, the steel achieves small grains through the precipitation of fine MX particles during hot working. By doing so the small equiaxed grain structure formed during hot working is generally retained to lower temperatures. Thus, in this embodiment the combination of the chemical composition that provides precipitation of fine MX particles and the thermal mechanical treatment are uniquely combined to create a fine grain martensitic stainless steel. Because the MX particles are coarsening-resistant, after the steel is cooled to room temperature, it can be reheated (austenitized) to temperatures up to about 1150° C. without appreciable grain growth. After the fine-grained microstructure has been created through thermal mechanical treatment, the steel of this embodiment retains its combination of tensile properties and toughness even when reaustenitized at relatively high temperatures and after it is tempered.

Additional details of another embodiment of the thermal mechanical treatment according to one aspect of the present disclosure are described below:

It has been found that recrystallization kinetics for the present alloy are primarily determined by three hot working parameters, deformation temperature, starting austenite grain size, and true strain of deformation. Other factors, for example strain rate, have been found to have less influence. In the steel of this embodiment, the starting austenite grain size is primarily determined by the soaking temperature and soaking time, and the amount of strong carbide and nitride forming elements present.

If conventional martensitic stainless steels are hot worked at a high enough temperature and great enough true strain, recrystallization will occur. (If the temperature is not high enough, or the strain is not great enough, or the starting grain size is too large, then pancaking will result). The newly-formed recrystallized grains then grow in size; the higher the hot working temperature, the faster the grain growth. In conventional martensitic stainless steels it has been found that grain growth occurs when the volume fraction and number density of fine, second phase particles is too small to effectively pin the growing grains.

In this embodiment the grain growth after recrystallization is limited due to the induced presence of small, secondary, MX particles that precipitate during hot working. In one embodiment, the hot working temperature is greater than about 1000° C. In another embodiment the true strain is greater than about 15% (0.15) for recrystallization to occur within a reasonable time frame (for a typical starting austenite grain size), and for the dislocation density to be great enough to facilitate precipitation of secondary MX particles.

In one embodiment, a method of creating a fine-grained martensitic stainless steel with good mechanical properties has been disclosed that involves: (i) choosing the appropriate amount of carbon and strong carbide forming element(s) to provide a sufficient volume fraction and number density of secondary MX precipitates to effectively reduce the growth kinetics of newly-formed grains during and after recrystallization; (ii) balancing the amounts of non-precipitating austenite and ferrite stabilizing elements to maintain an austenite structure at high temperatures that is transformable to martensite at room temperature (without significant amounts of retained austenite or delta ferrite) (iii) adding the appropriate amount of chromium for adequate corrosion resistance; (iv) adding sufficient quantities of deoxidizing elements and impurity gettering elements; (v) recrystallizing the microstructure to create a fine grain size; (vi) precipitating fine MX particles by thermal mechanical treatment; and (vii) cooling the stainless steel to room temperature.

In one embodiment, there is disclosed a martensitic alloy in which the ASTM grain size number is at least 5, including (wt. %) up to about 0.5% C, at least about 5% Cr, at least about 0.5% Ni, up to about 15% Co, up to about B % Cu, up to about 8% Mn, up to about 4% Si, up to about 6% (Mo+W), up to about 1.5% Ti, up to about 3% V, up to about 0.5% Al, and at least about 40% Fe. In another embodiment, the alloy includes at least about 0.005% (Al+Si+Ti). In another embodiment, the alloy includes up to about 0.3% C. In another embodiment, the alloy includes up to about 0.15% C. In another embodiment, the alloy includes about 0.05 to about 0.16% C. In another embodiment, the alloy includes at least about 7-5% Cr. In another embodiment the alloy includes at least about 10% Cr. In another embodiment, the alloy includes about 7.5 to about 15% Cr. In another embodiment, the alloy includes at least about 1% Ni. In another embodiment, the alloy includes at least about 2% Ni. In another embodiment the alloy includes about 1 to about 7% Ni. In another embodiment the alloy includes up to about 10% Co. In another embodiment the alloy includes up to about 7.5% Co. In another embodiment the alloy includes up to about 5% Co. In another embodiment, the alloy includes up to about 6% Cu. In another embodiment, the alloy includes up to about 3% Cu. In another embodiment the alloy includes up to about 1% Cu. In another embodiment, the alloy includes up to about 5% Mn. In another embodiment the alloy includes up to about 3% Mn. In another embodiment the alloy includes up to about 1% Mn. In another embodiment, the alloy includes up to about 2% Si. In another embodiment the alloy includes up to about 1.6% Si. In another embodiment the alloy includes up to about 1% Si. In another embodiment the alloy includes up to about 4% (Mo+W). In another embodiment the alloy includes up to about 3% (Mo+W). In another embodiment the alloy includes up to about 2% (Mo+W). In another embodiment the alloy includes up to about 0.75% Ti. In another embodiment the alloy includes up to about 0.5% Ti. In another embodiment, the alloy includes about 0.01 to about 0.75% Ti. In another embodiment, the alloy includes up to about 2% V. In another embodiment the alloy includes up to about 1% V. In another embodiment the alloy includes up to about 0.5% V. In another embodiment, the alloy includes up to about 0.2% Al. In another embodiment, the alloy includes up to about 0.1% Al. In another embodiment, the alloy includes up to about 0.05% Al. In another embodiment, the alloy includes at least about 50% Fe. In another embodiment, the alloy includes at least about 60% Fe. In another embodiment, the alloy includes at least about 50% Fe. In another embodiment, the alloy includes at least about 0.01% (Al+Si+Ti). In another embodiment the alloy includes at least about 0.02% (Al+Si+Ti). In another embodiment, the alloy includes at least about 0.04% (Al+Si+Ti). In another embodiment, the alloy having the ASTM grain size number is at least 7. In another embodiment, the alloy having the ASTM grain size number is at least 10. In another embodiment the alloy having the ASTM grain size number is at least 12. In another embodiment the alloy includes secondary MX particles having an average size less than about 400 nm. In another embodiment, the alloy includes secondary MX particles having an average size less than about 200 nm. In another embodiment the alloy includes secondary MX particles having an average size less than about 100 nm. In another embodiment, the alloy includes secondary MX particles having an average size less than about 50 nm. In another embodiment, the alloy includes an Ac1 temperature between 500° C. and 820° C. In another embodiment, the alloy is in a hot worked condition. In another embodiment the alloy is in a rolled condition. In another embodiment, the alloy is in a cast condition. In another embodiment, the alloy is in a forged condition. In another embodiment, the alloy contains less than 5% copper, less than 5% manganese, less than 1.5% silicon, less than 2% zirconium, less than 4% tantalum, less than 4% hafnium, less than 1% niobium, less than 2% vanadium, less than 0.1% of each member of the group consisting of aluminum, cerium, magnesium, scandium, yttrium, lanthanum, beryllium, and boron, and less than 0.02% of each member and less than 0.1 total weight percent of all members of the group consisting of sulfur, phosphorus, tin, antimony, and oxygen. In another embodiment, the alloy includes Cr+Ni in the range 5.0% to 14.5%. In another embodiment, the alloy contains W+Si+Mo less than 4%. In another embodiment, the alloy satisfies the equation: $0.135<1.1Ti+0.6Nb+0.5Zr+0\text{-}31Ta+0.31Hf<1.0$. In another embodiment, the alloy contains less than 40% delta ferrite by volume.

In one embodiment, there is disclosed a method of producing an alloy including preparing an alloy comprising (wt. %) up to about 0.5% C, at least about 5% Cr, at least about 0.5% Ni, up to about 15% Co, up to about 8% Cu, up to about 8% Mn, up to about 4% Si, up to about 6% (Mo+V), up to about 1.5% Ti, up to about 3% V, up to about 0.5% Al, and at least about 40% Fe; hot working the alloy at a temperature greater than about 800° C. to impart a true strain of greater than about 0.075 (7.5%); and cooling the alloy to room temperature to obtain a fine-grained martensitic microstructure. In another embodiment the method also includes thermal mechanically treating the alloy by austenitizing at a temperature of at least about 800° C. In another embodiment, be hot working temperature is at least about 900° C. In another embodiment, the hot working temperature is at least about 1000° C. In another embodiment the hot working temperature is at least about 1200° C. In another embodiment, the true strain is greater than about 0.10 (10%). In another embodiment the true strain is greater than about 0.15 (15%). In another embodiment, the true strain is greater than about 0.20 (20%). In another embodiment, the alloy comprising at least about 0.005% (Al+Si+Ti). In another embodiment the alloy comprising up to about 0.3% C. In another embodiment, the alloy comprising up to about 0.15% C. In another embodiment, the alloy comprising about 0.05 to about 0.15% C. In another embodiment, the alloy comprising at least about 7.5% Cr. In another embodiment, the alloy comprising at least about 10% Cr. In another embodiment the alloy comprising about 7.5 to about 15% Cr. In another embodiment, the alloy comprising at least about 1% Ni. In another embodiment, the alloy comprising at least about 2% Ni. In another embodiment the alloy comprising about 1 to about 7% Ni. In another embodiment the alloy comprising up to about 10% Co. In another embodiment the alloy comprising up to about 7.5% Go. In another embodiment, the alloy comprising up to about 5% Co. In another embodiment, the alloy comprising up to about 5% Cu. In another embodiment the alloy comprising up to about 3% Cu. In another embodiment, the alloy comprising up to about 1% Cu. In another embodiment, the alloy comprising up to about 5% Mn. In another embodiment, the alloy comprising up to about 3% Mn. In another embodiment the alloy comprising up to about 1% Mn. In another embodiment, the alloy comprising up to about 2% Si. In another embodiment, the alloy comprising up to about 1.5% Si. In another embodiment, the alloy comprising up to about 1% Si. In another embodiment, the alloy comprising up to about 4% (Mo+W). In another embodiment, the alloy comprising up to about 3% (Mo+W). In another embodiment, the alloy comprising up to about 2% (Mo+W). In another embodiment the alloy comprising up to about 0.75% Ti. In another embodiment, the alloy comprising up to about 0.5% Ti. In another embodiment, the alloy comprising about 0.01 to about 0.75% Ti. In another embodiment, the alloy comprising up to about 2% V. In another embodiment, the alloy comprising up to about 1% V. In another embodiment, the alloy comprising up to about 0.5% V. In another embodiment the alloy comprising up to about 0.2% Al. In another embodiment, the alloy comprising up to about 0.1% Al. In another embodiment, the alloy comprising up to about 0.05% Al. In another embodiment, the alloy comprising at least about 50% Fe. In another embodiment the alloy comprising at least about 60% Fe. In another embodiment the alloy comprising at least about 80% Fe. In another embodiment, the alloy comprising at least about 0.01% (Al+Si+Ti). In another embodiment the alloy comprising at least about 0.02% (Al+Si+Ti). In another embodiment, the alloy comprising at least about 0.04% (Al+Si+Ti). In another embodiment the alloy having an ASTM grain size number of at least 5. In another embodiment the alloy having an ASTM grain size number of at least 7. In another embodiment the alloy having an ASTM grain size number of at least 10. In another embodiment the alloy having an ASTM grain size number of at least 12. In another embodiment, the alloy having secondary MX particles having an average size less than about 400 nm. In another embodiment the alloy having secondary MX particles having an average size less than about 200 nm. In another embodiment, the alloy having secondary MX particles having an average size less than about 100 nm. In another embodiment the alloy having secondary MX particles having an average size less than about 50 nm.

In one embodiment there is disclosed a fine-grained iron base alloy in which the ASTM grain size number is greater than or equal to 5, including (wt. %) about 0.09 C, 10.7 Cr, 2.9 Ni, 0.4 Mn, 0.5 Mo, 0.15 Si, 0.04 Ai, 0.25 Ti, 0.12 V, 0.06 Nb, 0.002 B, and the balance essentially iron and impurities. In another embodiment there is disclosed a method of producing a fine-grained iron base alloy comprises preparing the iron base alloy as above and thermal mechanically treating by austenitizing it at a temperature above 1000° C., hot working the alloy at a temperature greater than 1000° C. to impart a true strain of greater than about 0.15 (15%), and cooling the alloy to room temperature to obtain a fine-grained martensitic microstructure in which the ASTM grain size number is greater than or equal to 5.

In one embodiment there is disclosed an article of manufacture comprising an iron based alloy, the alloy having an ASTM grain size of at least about 5, the alloy including (wt. %) up to about 0.5% C, at least about 5% Cr, at least about 0.5% Ni, up to about 15% Co, up to about 8% Cu, up to about 8% Mn, up to about 4% Si, up to about 6% (Mo+W), up to about 1.5% Ti, up to about 3% V, up to about 0.5% Al, and at least about 40% Fe. In another embodiment, the alloy is in a cast condition. In another embodiment, the alloy is in a forged condition. In another embodiment the alloy is in a hot worked condition. In another embodiment, the alloy is in a rolled condition. In another embodiment, the article of manufacture is used in the chemical or petrochemical industries. In another embodiment, the article of manufacture is selected from the group consisting of boiler tubes, steam headers, turbine rotors, turbine blades, cladding materials, gas turbine discs, and gas turbine components. In another embodiment, the article of manufacture comprises a tubular member. In another embodiment, the article of manufacture comprises a tubular member installed in a borehole.

EXAMPLE 1

An iron based alloy with a fine grain size having good corrosion resistance with high strength and toughness having the composition (wt. %):

| | |
|---|---|
| C | 0.05 < C < 0.15 |
| Cr | 7.5 < Cr < 15 |
| Ni | 1 < Ni < 7 |
| Co | Co < 10 |
| Cu | Cu < 5 |
| Mn | Mn < 5 |
| Si | Si < 1.5 |
| W, Mo | (W + Mo) < 4 |
| Ti | 0 < Ti < 0.75 |
| Ti, Nb, Zr, Ta, Hf | 0.135 < (1.17Ti + 0.6Nb + 0.6Zr + 0.31Ta + 0.31Hf) < 1 |
| V | V < 2 |
| N | N < 0.1 |
| Al | Al < 0.2 |
| Al, Si, Ti | (Al + Si + Ti) > 0.01 |
| B, Ce, Mg, Sc, Y, La, Be, Ca | <0.1 (each) |
| P | <0.1 |
| S | <0.05 |
| Sb, Sn, O, Pb | <0.1 (each) |
| and, with other impurities, the balance essentially iron. | |

In order to create a fine-grained microstructure, according to one embodiment the alloy is thermal mechanically treated. One embodiment of a thermal mechanical treatment includes soaking the alloy in the form of a 15 cm thick slab at 1230° C. for 2 hours such that the structure is mostly face-centered-cubic (austenite) throughout the alloy. The slab is then hot worked on a reversing rolling mill at a temperature between 1230° C. and 1150° C. during which time a true strain of 0.22 to 0.24 per pass is imparted to recrystallize the microstructure. The resulting plate is then air-cooled to room temperature so that it transforms to martensite. The thermal mechanical treatment given above and applied to the indicated alloy resulted in a fine grain, fully martensitic microstructure in which the ASTM grain size number is greater than or equal to 5. For reference, a sample ASTM grain size No. 5 is shown in FIG. 1.

FIG. 1 shows a reference illustration of nominal ASTM grain size No. 5. The specimen shown (Nital etch; image magnification: 100×) has a calculated grain size No. of 4.98.

The ASTM grain size number can be calculated as follows:

$$N(0.01\text{ in})^2 = N(0.0645\text{ mm}^2) = 2^{n-1}$$

where 'N' is the number of grains observed in an actual area of 0.0645 $mm^2$ (1 $in.^2$ at 100× magnification) and 'n' is the grain-size number. [Note: a 1 in.×1 in. area at 100×=0.0001 in 0.0645 $mm^2$.]

The hot working aspect of the thermal mechanical treatment as described may be applied through various methods including the use of conventional rolling mills to make bar, rod, sheet and plate, open-die, closed-die or rotary forging presses and hammers to make forged components, and Mannesmann piercing, multipass, mandrel and/or stretch reduction rolling mills or similar equipment used to manufacture seamless tubes and pipes.

In one embodiment, one or more types of hot working are used to impart a relatively large and uniform amount of true strain to the work piece while it is hot. Although the work piece may be repeatedly hot worked as it cools, hot working should stop when the temperature decreases below about 1000° C., otherwise pancaking may occur and mechanical properties may be degraded.

In another embodiment after thermal mechanical treatment, the alloy may be subsequently heat treated. For purposes of this patent application the term "heat treatment" as used herein is not the same as the thermal mechanical treatment described above. Rather, "heat treatment" refers to a process applied after the component has been formed, namely after it has been thermal mechanically treated and cooled to a temperature below the martensite finish temperature to form a fine-grained martensitic stainless steel product. Specifically, heat treatment of the steel may include tempering; austenitizing, quenching and tempering; normalizing and tempering; normalizing; and austenitizing and quenching. It should be understood that in order to manufacture a commercial product utilizing the technology disclosed herein, product quality issues, such as surface quality and dimensional tolerance, should also be adequately addressed.

EXAMPLE 2

A second example is given below in which two heats with similar compositions were given different thermal mechanical treatments. The composition of each heat is given in Table 1. Heat #1703 was rolled into a round bar, while heat #4553 was forged into a round bar; each process used a different thermal mechanical treatment Less than about 15% true strain was used during hot working passes to produce the bar made from heat #4553, while the bar made from heat #1703 was rolled using greater than about 15% true strain. It will be understood that true strain, e, is defined as In $(L/L_0)$, where 'L' is the length after hot working and '$L_0$' is the length before hot working (the original length). Similarly, one can use cross sectional area to calculate the true strain. In this case, 6=In $(A_0/A)$, where 'A' is the cross sectional area after hot working, '$A_0$' is the cross sectional area before hot working, and $A=(A_0L_0)/L$ if the deformation is uniform and assuming plastic deformation occurs at constant volume. For example, if the cross sectional area of a work piece is 10 $cm^2$ before rolling and 8 $cm^2$ after a rolling pass, a true strain of In (10/8)=0.223 (22.3%) would have been imparted. The mechanical properties of both steel samples were determined and are given in Table 2. Whereas both sample bars have approximately the same yield strength, ultimate tensile strength and elongation, heat #1703 exhibits much greater Charpy V-notch impact energy than does heat #4553, despite the fact that the impact toughness test performed on heat #1703 was conducted at a lower temperature compared to heat #4553 (−29° C. vs.+24° C.), These data indicate that high strength and high toughness can be achieved in the steel of the current example if the proper thermal mechanical treatment is used to create a fine-grained microstructure. Conversely, if an improper heat treatment is applied, the resulting grain size will be relatively large and poor mechanical properties may result.

TABLE I

| | Composition of heat #1703 and heat #4553 | | | | | | | | | |
|---|---|---|---|---|---|---|---|---|---|---|
| Heat # | C | Cr | Ni | Mn | Mo | Si | V | Nb | Al | Ti |
| 1703 | 0.089 | 10.66 | 2.38 | 0.5 | 0.47 | 0.15 | — | — | 0.024 | 0.37 |
| 4553 | 0.083 | 10.83 | 2.42 | 0.28 | 0.49 | 0.20 | 0.030 | 0.015 | 0.0384 | 0.38 |

TABLE II

| Mechanical properties of bars made from heat #1703 and heat #4553 | | | | | |
|---|---|---|---|---|---|
| Heat # | Yield strength | Ultimate tensile strength | Elongation | Charpy V-notch properties energy | Charpy V-notch properties test temperature |
| 1703 | 821 MPa | 931 MPa | 18% | 163 J | −29° C. |
| 4553 | 807 MPa | 917 MPa | 14% | 8 J | 24° C. |

Figure 2:
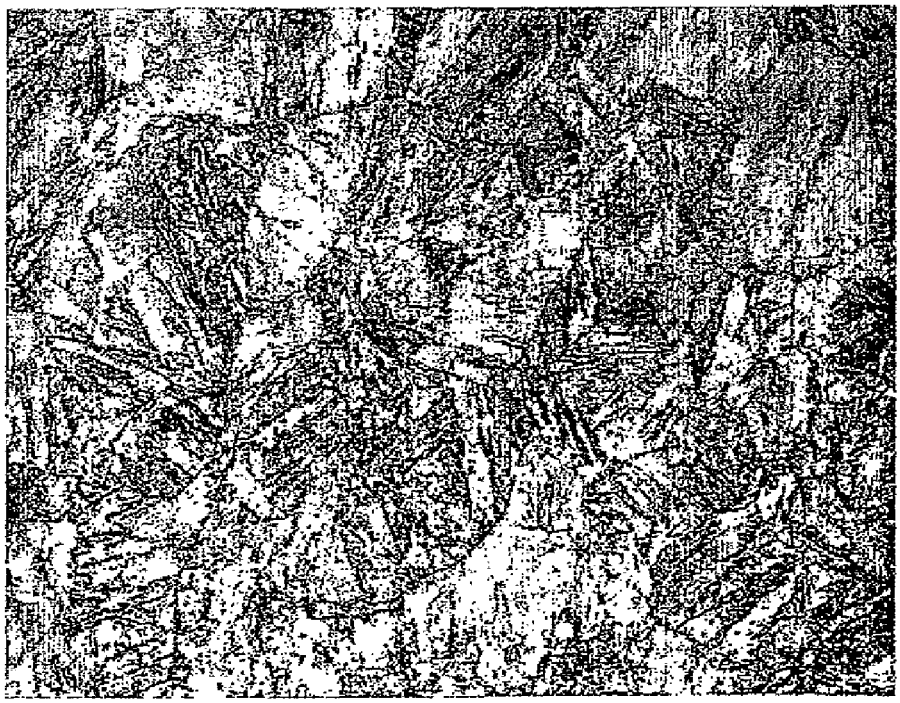
FIG. 2 shows a microstructure magnified at 100×.

FIG. 2 shows a microstructure of a steel in which a true strain of less than 15% (0.15) was applied during hot working. The photomicrograph (Vilella's etch) is at a magnification of 100×. The approximate grain size is ASTM No. 3 (coarse grains).

Figure 3:
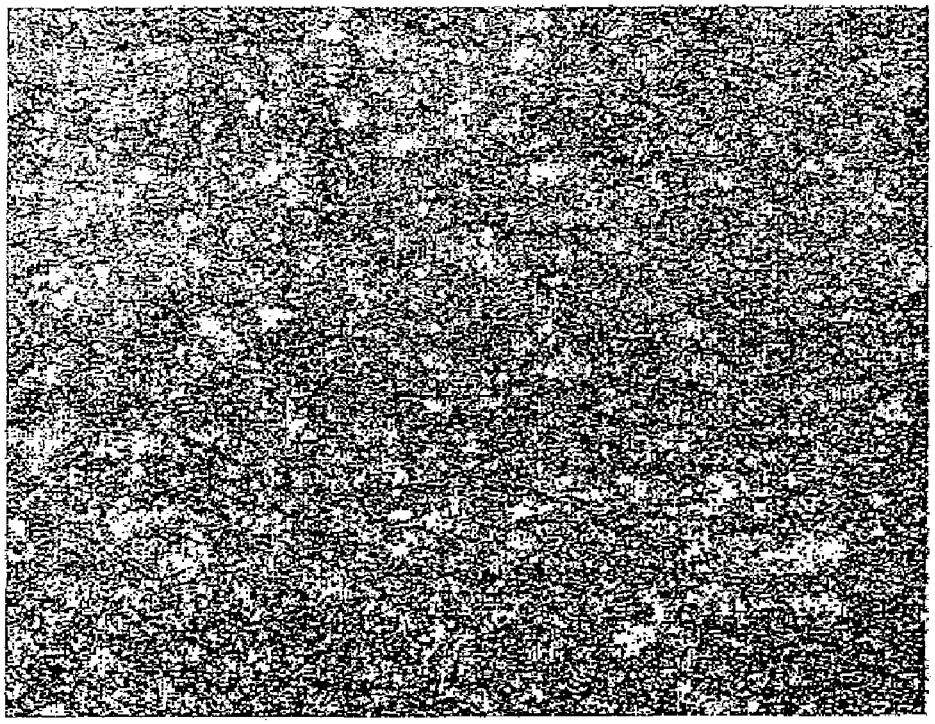
FIG. 3 shows a microstructure magnified at 100×.

FIG. 3 shows a microstructure of a steel in which a true strain of greater than 15% was applied during hot working. The photomicrograph (Vilella's etch) is at a magnification of 100×. The approximate grain size is ASTM No. 10 (fine grains).

Although several embodiments of alloys and manufacturing methods have been described, it should be understood that the alloys and methods are not limited to only the described embodiments, but those embodiments are merely illustrative and should not be used to interpret the scope of the claims set forth below. It is contemplated that a wide range of modification, changes and substitution is contemplated in the foregoing disclosure. In some instances, some features of the present disclosure may be employed without a corresponding use of the other features.

What I claim is:

1. A method of producing an alloy comprising:

preparing an alloy comprising (wt. %):

greater than 0.05% and less than 0.15% C;
greater than 7.5% and less than 15% Cr;
greater than 1% and less than 7% Ni;
up to about 15% Co;
up to about 8% Cu;
up to about 8% Mn;
up to about 4% Si;
up to about 6% (Mo+W);
greater than 0.01% and less than 0.75% Ti;
less than 0.1% N;
up to about 2% Al; and
at least about 40% Fe;

thermal mechanically treating by austenitizing the alloy at a temperature greater than 1000° C.;

hot working the alloy at a temperature greater than 1000° C. to impart a true strain of greater than about 0.20 (20%); and cooling the alloy to room temperature to obtain a fine-grained martensitic microstructure in which the ASTM grain size is greater than or equal to 5.

2. The method of claim 1, wherein the hot working temperature is at least about 1200° C.

3. The method of claim 1, the alloy comprising about greater than 1 to about 5% Ni.

4. The method of claim 1, the alloy comprising up to about 5% Co.

5. The method of claim 1, the alloy comprising up to about 1.2% Cu.

6. The method of claim 1, the alloy comprising up to about 1% Mn.

7. The method of claim 1, the alloy comprising up to about 1% Si.

8. The method of claim 1, the alloy comprising up to about 2% (Mo+W).

9. The method of claim 1, the alloy comprising up to about 0.5% Ti.

10. The method of claim 1, the alloy comprising up to about 0.5% V.

11. The method of claim 1, the alloy comprising up to about 0.05% Al.

12. The method of claim 1, the alloy comprising at least about 80% Fe.

13. The method of claim 1, the alloy comprising at least about 0.04% (Al+Si+Ti).

14. The method of claim 1, the alloy having an ASTM grain size number of at least 7.

15. The method of claim 1 the alloy having an ASTM grain size number of at least 10.

16. The method of claim 1, the alloy having an ASTM grain size number of at least 12.

17. A method of producing a fine-grained iron base alloy comprising:

preparing an iron base alloy comprising (wt. %) about: 0.09 C, 10.7 Cr, 2.9 Ni, 0.4 Mn, 0.5 Mo, 0.15 Si, 0.04 Al, 0.25 Ti, 0.12 V, 0.06 Nb, 0.002 B, and the balance essentially iron and impurities, thermal mechanically treating by austenitizing it at a temperature above 1000° C., hot working the alloy at a temperature greater than 1000° C. to impart a true strain of greater than about 0.15 (15%), and cooling the alloy to room temperature to obtain a fine-grained martensitic microstructure in which the ASTM grain size number is greater than or equal to 5.

18. A method of producing a fine-grained iron base alloy comprising: preparing an iron base alloy consisting essentially of (wt. %): $0.05<C<0.15$; $7.5<Cr<15$; $1<Ni<7$; $Co<10$, $Cu<5$; $Mn<5$; $Si<1.5$; $(Mo+W)<4$; $0.01<Ti<0.75$; $0.135<(1.17\ Ti+0.6\ Nb+0.6\ Zr+0.31\ Ta+0.31\ Hf<1$; $V<2$; $N<0.1$; $Al<0.2$; $(Al+Si+Ti)>0.01$; each of B, Ce, Ca, Mg, Sc, Y, La and Be less than 0.1; $P<0.1$; $S<0.05$; each of Sn, Sb, O, Pb and other impurities less than 0.1; and the balance essentially iron; thermal mechanically treating by austenitizing it at a temperature above 1000° C., hot working the alloy at a temperature greater than 1000° C. to impart a true strain of greater than 0.15 (15%); and cooling the alloy to room temperature to obtain a fine-grained martensitic microstructure in which the ASTM grain size number is greater than or equal to 5.

19. The method of claim 18, wherein hot rolling the iron base alloy further comprises forming the iron base alloy into a tubular product.

20. The method of claim 18, further comprising heat treating the iron base alloy after the iron base alloy is cooled to room temperature and retaining a fine grain size in which the ASTM grain size number is greater than or equal to 5.

21. The method of claim 20, wherein heat treating the iron base alloy after the iron base alloy is cooled to room temperature further comprises tempering the iron base alloy.

22. The method of claim 20, wherein heat treating the iron base alloy after the iron base alloy is cooled to room temperature further comprises austenitizing, quenching and tempering the iron base alloy.

23. The method of claim 20, wherein heat treating the iron base alloy after the iron base alloy is cooled to room temperature further comprises normalizing and tempering the iron base alloy.

24. The method of claim 20, wherein heat treating the iron base alloy after the iron base alloy is cooled to room temperature further comprises normalizing the iron base alloy.

25. The method of claim 20, wherein heat treating the iron base alloy after the iron base alloy is cooled to room temperature further comprises austenitizing and quenching the iron base alloy.

* * * * *